US006700541B2

(12) United States Patent
Konishi

(10) Patent No.: US 6,700,541 B2
(45) Date of Patent: Mar. 2, 2004

(54) ANTENNA ELEMENT WITH CONDUCTORS FORMED ON OUTER SURFACES OF DEVICE SUBSTRATE

(75) Inventor: Takayoshi Konishi, Tokyo (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 25 days.

(21) Appl. No.: 10/112,946

(22) Filed: Apr. 2, 2002

(65) Prior Publication Data

US 2003/0001781 A1 Jan. 2, 2003

(30) Foreign Application Priority Data

Jun. 29, 2001 (JP) ..... 2001-198977

(51) Int. Cl.[7] ..... H01Q 1/38; H01Q 1/24

(52) U.S. Cl. ..... 343/700 MS; 343/702; 343/873

(58) Field of Search ..... 343/700 MS, 702, 343/873, 895; H01Q 1/38, 1/24

(56) References Cited

U.S. PATENT DOCUMENTS

| | | | | | |
|---|---|---|---|---|---|
| 6,028,554 | A | * | 2/2000 | Mandai et al. | 343/700 MS |
| 6,040,806 | A | * | 3/2000 | Kushihi et al. | 343/853 |
| 6,346,925 | B1 | * | 2/2002 | Matsumoto | 343/702 |
| 2002/0101382 | A1 | * | 8/2002 | Konishi et al. | 343/702 |

* cited by examiner

*Primary Examiner*—Hoanganh Le
(74) *Attorney, Agent, or Firm*—Young & Thompson

(57) ABSTRACT

An antenna element is formed with an extended portion, bent in a U-shape, in at least one of a first conductor and a second conductor of a conductive path. This structure permits the conductive path to be extended without increasing the size of the overall shape, so that the overall shape of the antenna element can be made compact without relatively extending the conductive path.

42 Claims, 8 Drawing Sheets

ANTENNA ELEMENT WITH CONDUCTORS FORMED ON OUTER SURFACES OF DEVICE SUBSTRATE

BACKGROUND OF THE INVENTION

1. Field of the Invention

The present invention relates to an antenna element for use in reception or transmission of radio waves, and more particularly, to an antenna element which has conductors formed on its outer surfaces of a device substrate.

2. Description of the Related Art

At present, radio communication apparatuses called a mobile telephone and the like are pervasive in general users, and a reduction in size and weight is required for the radio communication apparatuses. The radio communication apparatus receives and transmits radio waves through an antenna element, where the total length of a conductive path is closely related to the wavelength of a radio wave transmitted or received thereby.

For this reason, since a simple reduction in the length of the conductive path causes a rise in the resonant frequency, difficulties are encountered in efficiently radio communicating a radio wave at a predetermined frequency. To address this problem, a variety of techniques have been devised for reducing the shape of an overall antenna element while maintaining a required resonant frequency.

For example, an antenna element called a helical antenna has a conductive path formed in a spiral shape, while an antenna element called a meander antenna has a conductive path in a meandering shape. While these antennas do not achieve a reduction in the total length of the conductive path, the overall shape can be substantially reduced.

There is also an antenna element called a dielectric antenna which has a conductive path formed on the surface of a dielectric material to reduce the length of the conductive path. Since the wavelength of a radio wave is reduced within a member having a high dielectric constant or permeability, the formation of the conductive path on or within a dielectric material or a magnetic material results in a reduction in the total length thereof.

Moreover, there is an antenna element called a loaded antenna which adds a reactance element, an inductance element or a capacitance element to a conductive path to reduce the length of the conductive path. It should be understood that a variety of foregoing techniques may be combined, for example, to create an antenna element which has a conductive path formed in a helical shape or in a meander shape on the surface of a dielectric material.

An antenna element can be made compact by a variety of techniques as described above. However, in the helical antenna and meander antenna, a long conductive path is bent to reduce the area occupied thereby, so that adjacent portions of the conductive path are electromagnetically coupled to cause an increase in surface current and high frequency loss.

To solve the problem as mentioned, the present inventor invented an antenna element which has a conductive path formed in a shape different from the helical shape or meander shape on the surface of a dielectric material, and filed the invention as Japanese Patent Application No. 2001-026002. This application discloses an antenna element which has a first conductor and a second conductor, parallel to each other, connected by a short-circuit conductor to form a loaded inductance.

Referring now to FIG. 1, the antenna element disclosed in the application will be described below in brief, as a related art which precedes the present invention and is not known. The antenna element described below was filed in Japan on Feb. 1, 2001 as Japanese Patent Application No. 2001-026002, and filed in the United States of America on Jan. 31, 2002 as U.S. Ser. No. 10/059423 by the present inventor. However, this application has not been opened in any country, so that this is not a prior art but merely a related art of the present invention.

Antenna element 100 in the aforementioned application has device substrate 101 made of a dielectric material in rectangular solid, and conductive path 102 formed of a printed wire on the front surface of device substrate 101 to implement a dielectric antenna as described above. Conductive path 102 is comprised of power supply conductor 103, first conductor 104, short-circuit conductor 105, and second conductor 106.

More specifically, power supply conductor 103 of conductive path 102 comprises a linear portion formed from the bottom surface to front surface of device substrate 101, while first conductor 104 comprises a linear portion formed from an upper end or terminate end of power supply conductor 103 and bent at a right angle to the right in the figure.

Short-circuit conductor 105 comprises a linear portion formed from a right end or terminate end of first conductor 104 and bent upward at a right angle in the figure, i.e., in the opposite direction to power supply conductor 103, while second conductor 106 comprises a linear portion formed from an upper end or terminate end of short-circuit conductor 105 and bent at a right angle to the left in the figure, and positioned in parallel with first conductor 104.

In antenna element 100 of the structure as described, conductive path 102 can be reduced in length since first conductor 104 and second conductor 106, positioned in parallel with each other, act as a loaded inductance. In addition, since conductive path 102 is generally bent in a U-shape (which has three straight lines forming two right angles), the overall shape can be made compact.

Unlike the meander antenna, helical antenna and the like, in spite of the reduction in size, first conductor 104 and second conductor 106, positioned in parallel with each other, are sufficiently spaced away from each other, so that their electromagnetic coupling is reduced, thereby making it possible to realize radio communications with high gain, high efficiency and wide band.

Antenna element 100 of the structure described above presents a rise in the resonant frequency as the overall shape is simply reduced in shape, whereas the resonant frequency is reduced as the loaded inductance is increased. In other words, when the resonant frequency is maintained constant, an increase in the loaded inductance can result in a relative reduction in the size of the overall shape.

The loaded inductance of conductive path 102 in the aforementioned antenna element 100 may be increased by spacing first conductor 104 and second conductor 106 away from each other, reducing the width of conductive path 102, extending the length of conductive path 102 such as first/second conductors 104, 106, and the like.

However, for spacing first conductor 104 and second conductor 106 away from each other, device substrate 101 must be extended, resulting in an increased size of the overall shape. The width of conductive path 102 has a lower limit determined by a thermal condition, and a reduction in the width of the conductive path 102 will cause a reduced bandwidth and an increased high frequency loss, so that the width of conductive path 102 cannot be reduced without prudence.

SUMMARY OF THE INVENTION

It is an object of the present invention to provide a antenna element which is made compact, and has a first conductor and a second conductor positioned in parallel with each other and connected through a short-circuit conductor.

The antenna element according to the present invention has a first conductor, a short-circuit conductor, a second conductor, and a device substrate. The device substrate is made of at least one of a dielectric material and a magnetic material, and is formed with the first conductor, short-circuit conductor and second conductor on its outer surface. The first conductor is made of a linear conductor supplied with electric power at a leading end thereof, while the short-circuit conductor is connected perpendicularly to a terminate end of the first conductor. The second conductor is connected at a right angle to a terminate end of the short-circuit conductor and positioned in parallel with the first conductor.

In a first aspect of the antenna element described above, an extended portion bent in a U-shape is formed in at least one of the first conductor and the second conductor. In a second aspect, the first conductor and second conductor are formed continuously on a plurality of outer surfaces of the device substrate. In a third aspect, the first conductor and second conductor are formed continuously on a plurality of outer surfaces of the device substrate, and an extended portion bent in a U-shape is formed in at least one of the first conductor and second conductor.

Thus, the antenna element of the present invention can extend the conductive path without increasing the size of the device substrate even though the parallel first conductor and second conductor are connected through the short-circuit conductor on the outer surface of the device substrate. It is therefore possible to reduce the size of the device substrate without relatively extending the conductive path, and reduce the size of the overall shape while ensuring a desired resonant frequency.

In another implementation of the antenna element as described above, a power supply conductor is also formed as part of the conductive path. The power supply conductor has a terminate end connected at a right angle to the leading end of the first conductor, and positioned on the opposite side to the short-circuit conductor. By supplying electric power to a leading end of the power supply conductor, the electric power can be supplied to the first conductor from the power supply conductor.

Since the first conductor and second conductor are formed from the front surface to the back surface across one side surface of the device substrate formed in rectangular solid, the conductive path can be extended, effectively making use of a plurality of outer surfaces of the solid device substrate.

Since the first conductor is formed at different positions on the front surface and rear surface of the device substrate, a portion of the first conductor positioned on the front surface of the device substrate can be spaced apart from a portion of the first conductor positioned on the back surface to reduce a distributed capacitance, thereby making it possible to prevent a reduction in the bandwidth of communication frequencies due to accumulation of unwanted electromagnetic energy.

Since the second conductor is formed at different positions on the front surface and rear surface of the device substrate, a portion of the second conductor positioned on the front surface of the device substrate can be spaced apart from a portion of the second conductor positioned on the back surface to reduce a distributed capacitance, thereby making it possible to prevent a reduction in the bandwidth of communication frequencies due to accumulation of unwanted electromagnetic energy.

Also, by virtue of:

- a conductive pathar connection of a leading end of the extended portion formed and connected to the leading end of the first conductor to a terminate end of the power supply conductor;
- a linear connection of a terminate end of the extended portion formed and connected to the terminate end of the first conductor to a leading end of the short-circuit conductor;
- a linear connection of the leading end of the extended portion formed and connected to the leading end of the second conductor to a terminate end of the short-circuit conductor; and
- a linear connection of the terminate end of the extended portion formed and connected to the terminate end of the second conductor to a leading end of a connection conductor, the shape can be simplified, even though the conductive path is extended, thus making it possible to improve the productivity of the antenna element.

Since a capacitive conductor having a given capacitance is connected to the terminate end of the second conductor, the conductive path can be reduced in length due to a capacitance load of the capacitive conductor.

Since the second conductor is formed integrally with a capacitive conductor of a given capacitance, the conductive path is reduced in length due to a capacitance load of the capacitive conductor. Since the capacitive conductor and second conductor need not be separately formed and connected to each other through a connection conductor, it is possible to simplify the structure to improve the productivity, and reduce the size of the overall shape.

Since a resonant circuit is formed of a resonant conductor formed at a predetermined position of at least one of the first conductor and second conductor to the vicinity of the other one, the resonant circuit permits the antenna element to support radio communications at a plurality of frequencies, making it possible to improve the performance of the antenna element.

Since a plurality of resonant conductors are connected respectively to at least one of the first conductor and second conductor, a plurality of resonant circuits resonate at different frequencies from one another, permitting the antenna element to support radio communications at a plurality of frequencies and at frequencies in a wide band.

A radio communication apparatus according to the present invention, with the provision of the antenna element of the present invention, can radio communicate a radio wave at a desired frequency through the small antenna element.

The above and other objects, features and advantages of the present invention will become apparent from-the following description with reference to the accompanying drawings which illustrate examples of the present invention.

DETAILED DESCRIPTION OF THE PREFERRED EMBODIMENTS

A first embodiment of the present invention will hereinafter be described with reference to FIGS. 2 through 5.

It should be first noted however that with respect to the following embodiments, parts identical to those of antenna element 100 described above are designated by the same names, and detailed description thereon is omitted. Also, while in the following embodiments, directions such as front and back, right and left, and up and down are referred to in correspondence to the drawings, these directions are used for convenience of simplifying the description and do not at all limit the directions in actual manufacturing and use of associated products.

Figure 1:
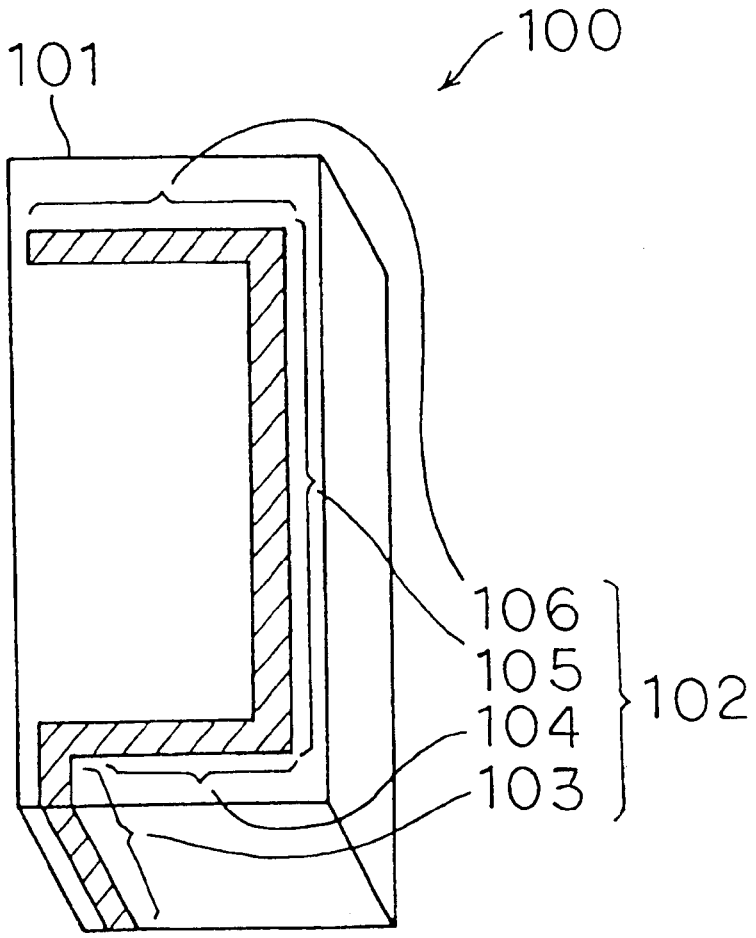
Fig.1(Related Art)
FIG. 1 is a perspective view illustrating an antenna element according to an unknown related art, invented by the present inventor.
Figure 2:
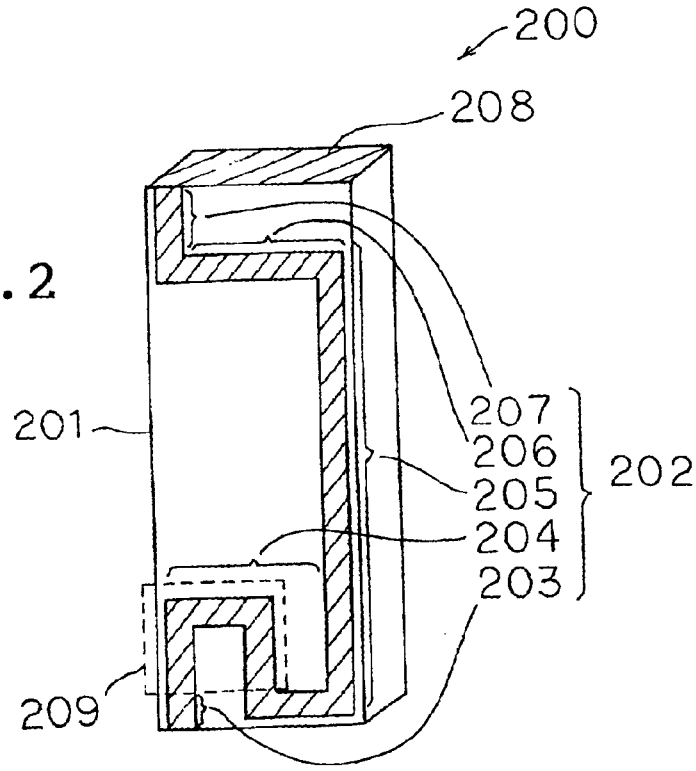
FIG. 2 is a perspective view illustrating an antenna element according to a first embodiment of the present invention.

Like the aforementioned antenna element 100, antenna element 200 in this embodiment comprises device substrate 201 made of a dielectric material in rectangular solid, and conductive path 202 formed of a printed wire or the like on the front surface of device substrate 201, as illustrated in FIG. 2. Conductive path 202 is comprised of a power supply conductor 203, first conductor 204, short-circuit conductor 205, and second conductor 206.

Unlike antenna element 100, connection conductor 207 is connected at a right angle to a terminate end of second conductor 206, and capacitive conductor 208 is connected to a terminate end of connection conductor 207. Capacitive conductor 208 is made of a conductor formed on a top surface of device substrate 201, and generates a given capacitance between ground electrode 302, later described, and itself. Antenna element 200 of this embodiment is also formed with extended portion 209 bent in a U-shape at a leading end of first conductor 204. A leading end of extended portion 209 is continuous to the terminate end of power supply conductor 203.

Figure 3:
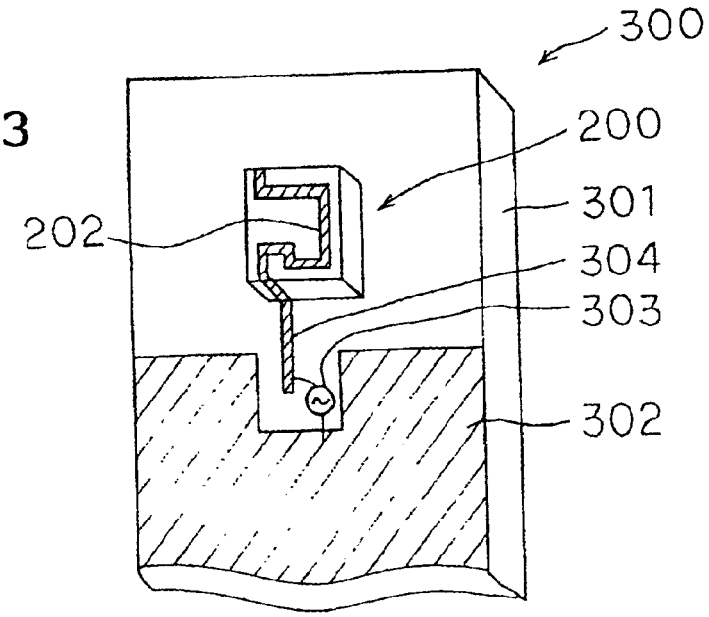
FIG. 3 is a perspective view illustrating a main portion of a radio communication apparatus according to one embodiment of the present invention.

As illustrated in FIG. 3, radio communication apparatus 300 in this embodiment has circuit board 301. In a lower half of the front surface of the circuit board 301, a copper foil is applied to form ground electrode 302. Ground electrode 302 has a portion thereof formed in recess, where power supply electrode 304 is formed for power supply circuit 303 which functions as a power supply means.

Figure 4:
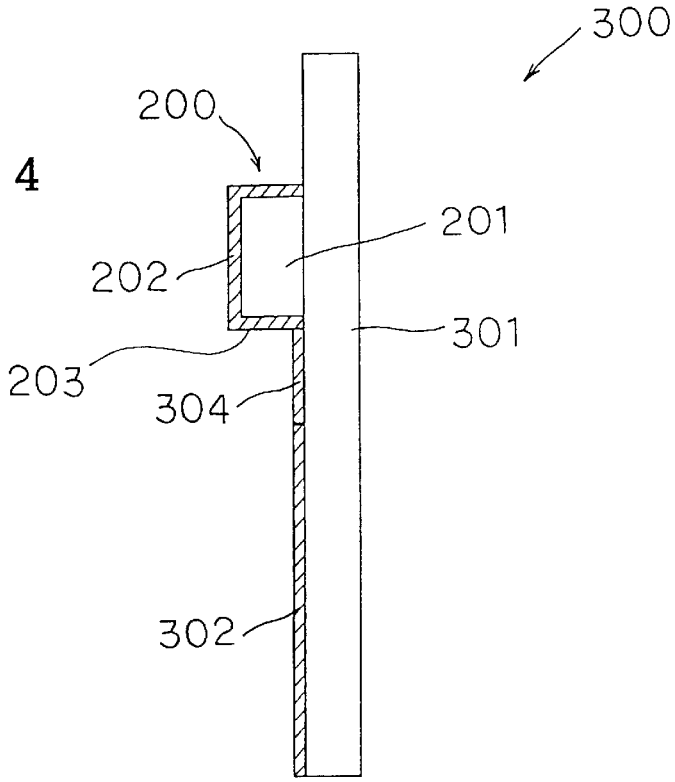
FIG. 4 is a vertical cross-sectional view illustrating a main portion of the radio communication apparatus.

In radio communication apparatus 300 in this embodiment, antenna element 200 is mounted on an upper half of the front surface of circuit board 301 on which ground electrode 302 is not formed. As illustrated in FIGS. 3 and 4, conductive path 202 of antenna element 200 has a leading end connected to a terminate end of power supply electrode 304.

Figure 5A:
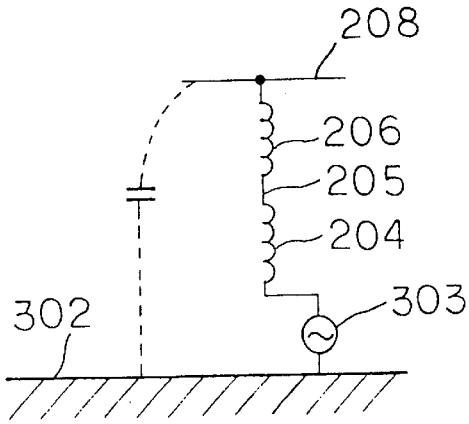
FIG. 5*a* is a schematic diagram illustrating a circuit function of the antenna element.

In the foregoing structure, antenna element 200 in this embodiment is similar to the aforementioned antenna element 100 in that first conductor 204 and second conductor 206, positioned in parallel with each other, act as a loaded inductance, as illustrated in FIG. 5*a*, so that the length of conductive path 202 is reduced to make the overall shape smaller, while ensuring a desired resonant frequency.

Unlike the meander antenna, helical antenna and the like, however, since first conductor 204 and second conductor 206 positioned in parallel to each other are sufficiently spaced away from each other, their electromagnetic coupling is reduced, making it possible to realize radio communications with high gain, high efficiency, and wide band.

Figure 5B:
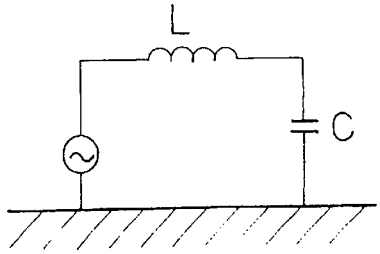
FIG. 5*b* is a circuit diagram illustrating an equivalent circuit of the antenna element.

Further, since capacitive conductor 208 is connected to a terminate end of conductive path 202, this capacitive conductor 208 has a large capacitance between ground electrode 302 and itself. For this reason, as illustrated in FIG. 5*b*, an equivalent circuit of antenna element 200 in this embodiment is represented by an LC series circuit, with a reduced resonant frequency, so that conductive path 202 can be relatively reduced further in length.

Moreover, since antenna element 200 in this embodiment has extended portion 209 formed in first conductor 204, conductive path 202 is extended without increasing the size of device substrate 201. In other words, device substrate 201 is made compact without relatively extending conductive path 202, 50 that the overall shape is made compact while ensuring a desired resonant frequency.

As described above, since first conductor 204 and second conductor 206 are sufficiently spaced away from each other, the formation of extended portion 209 in first conductor 204 will not cause strong electromagnetic coupling with second conductor 206, so that antenna element 200 in this embodiment can provide good radio communications.

Further, in antenna element 200 in this embodiment, extended portion 209 formed in first conductor 204 is connected in linear fashion to power supply conductor 203, so that the shape of antenna element 200 can be simplified while extending conductive path 202, thereby making antenna element 200 highly productive.

As appreciated, the present invention is not limited to the foregoing embodiment, and permits a variety of alterations without departing from the spirit and scope of the invention. For example, while antenna element 200 in the foregoing embodiment illustrates that extended portion 209 formed at the leading end of first conductor 204 is connected in a linear fashion to power supply conductor 203, the foregoing structure can be recognized as well in such a manner that an extended portion formed at the terminate end of first conductor 204 is connected in a linear fashion to short-circuit conductor 205.

Figure 6:
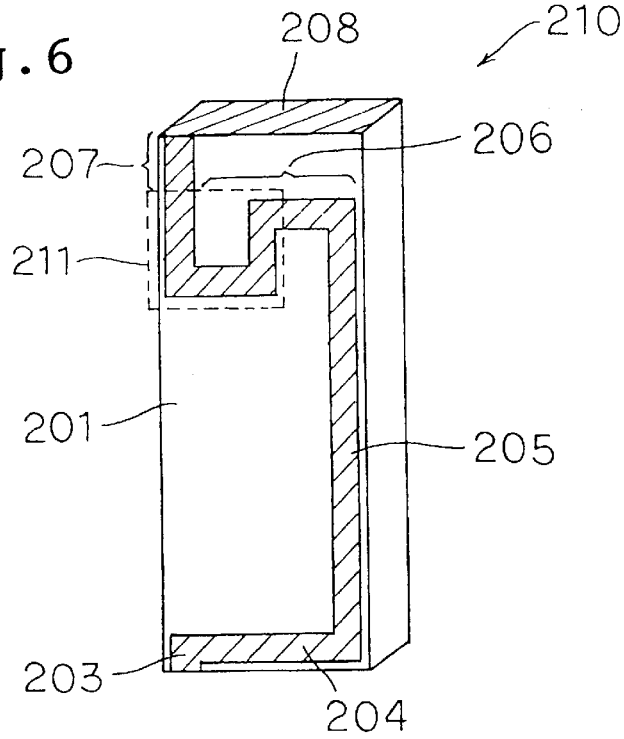
FIG. 6 is a perspective view illustrating a first exemplary modification to the antenna element of the first embodiment.

Alternatively, as antenna element 210 illustrated in FIG. 6, extended portion 211 may be formed at the terminate end of second conductor 206 and connected in a linear fashion to connection conductor 207, and this structure can be recognized as well in such a manner that an extended portion formed at the leading end of second conductor 206 is connected in a linear fashion to short-circuit conductor 205.

Figure 7:
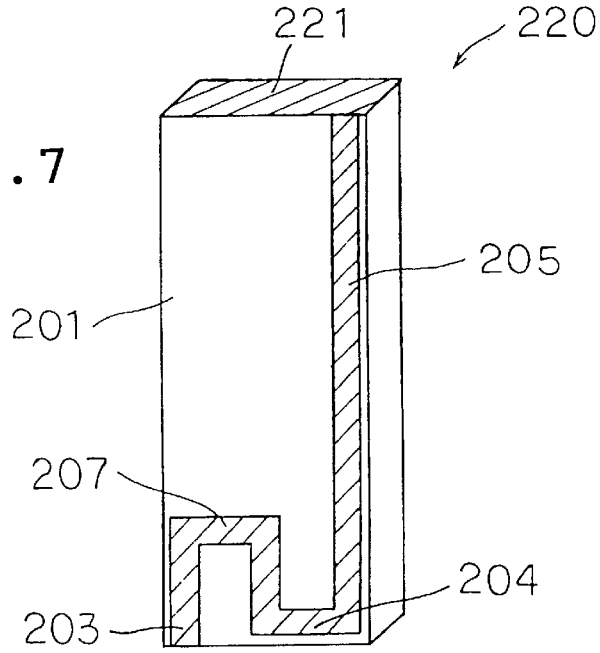
FIG. 7 is perspective view illustrating a second exemplary modification.

Further, while antenna element 200 in the foregoing embodiment illustrates that capacitive conductor 208 is formed on second conductor 206 by connection conductor 207, second conductor 221 can be formed integral with a capacitive conductor, as antenna element 220 illustrated in FIG. 7. Alternatively, antenna element 200 may not be formed either with capacitive conductor 208 or with connection conductor 207.

Further, while antenna element 200 in the foregoing embodiment illustrates that conductive path 202 is formed on its outer surface of device substrate 201, some antenna element (not shown) has a dielectric material integrally laminated on the outer surface of device substrate 201, on which conductive path 202 is thus formed, to form an element member. In this structure, even though conductive path 202 is positioned inside the element member made of the dielectric material, device substrate 201 is still positioned inside the element member, with conductive path 202 positioned on the outer surface of device substrate 201, as is the case with antenna element 200.

Figure 8:
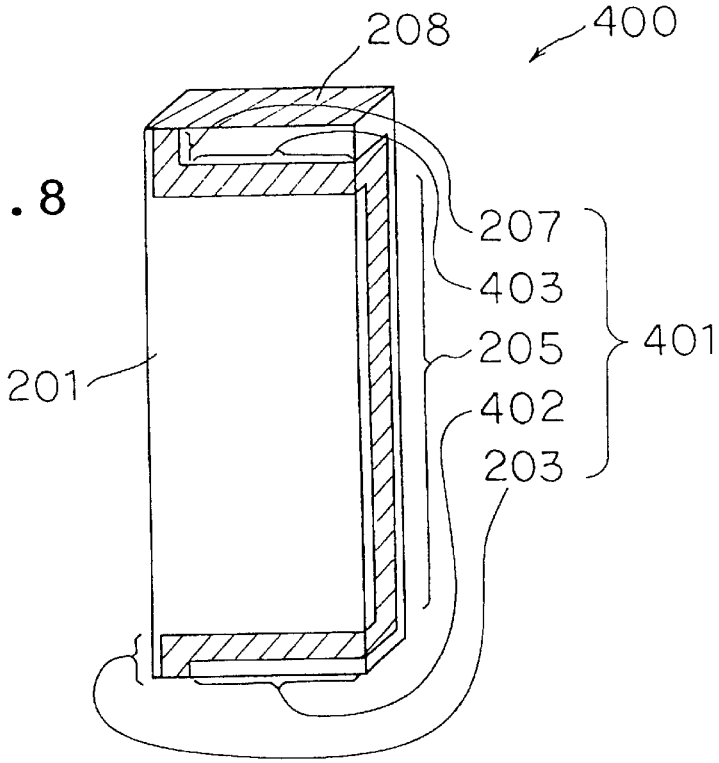
FIG. 8 is a perspective view illustrating an antenna element according to a second embodiment.

Next, a second embodiment of the present invention will be described below with reference to FIG. 8. In antenna element 400 in the second embodiment, though device substrate 201 is formed in rectangular solid just like the aforementioned antenna element 200 and the like, antenna element 400 differs from the aforementioned antenna element 200 and the like in that first conductor 402 and second conductor 403 of conductive path 401 are formed continuously from the front surface to one side surface of device substrate 201.

In the foregoing structure, antenna element 400 in the second embodiment can extend first conductor 402 and second conductor 403 without increasing the size of device substrate 201, so that the overall shape can be made compact while maintaining a desired resonant frequency. Particularly, since a plurality of outer surfaces of solid device substrate 201 are effectively utilized to extend first/second conductors 402, 403, first/second conductors 402, 403 can be extended as appropriate while they are sufficiently spaced away from each other.

As appreciated, the present invention is not limited to the foregoing second embodiment, and permits a variety of alterations without departing from the spirit and scope of the invention. For example, while antenna element 400 in the second embodiment illustrates that first/second conductors 402, 403 are formed continuously on a plurality of outer surfaces of device substrate 201, the aforementioned extended portions 209, 211 may be formed in first/second conductors 402, 403 which are continuously formed on a plurality of outer surfaces of device substrate 201 in the foregoing manner.

Figure 9:
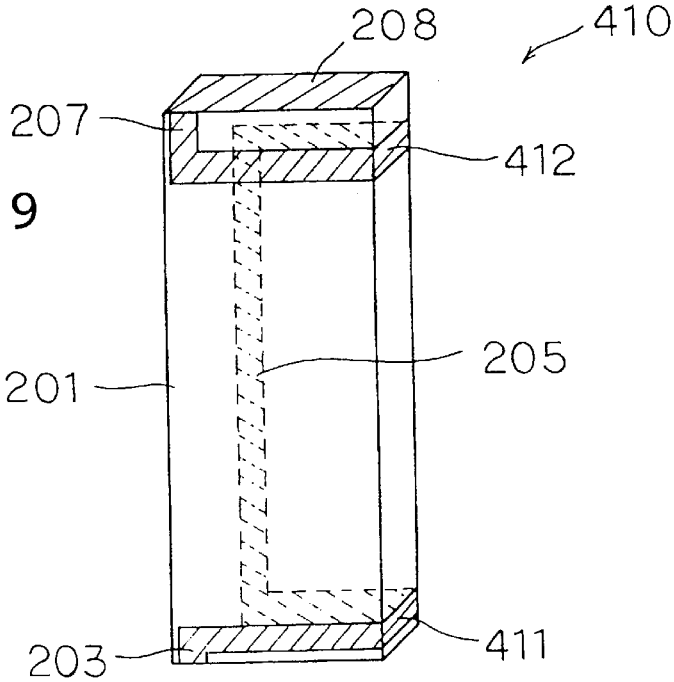
FIG. 9 is a perspective view illustrating a first exemplary modification to the antenna element of the second embodiment.

Also, while antenna element 400 in the second embodiment illustrates that first conductor 402 and second conductor 403 are formed continuously from the front surface to the side surface of device substrate 201, first conductor 411 and second conductor 412 may be continuously formed from the front surface to the back surface across one side surface of device substrate 201, for example, as antenna element 410 illustrated in FIG. 9, to further extend first/second conductors 411, 412 to relatively reduce the size of the overall shape.

Figure 10:
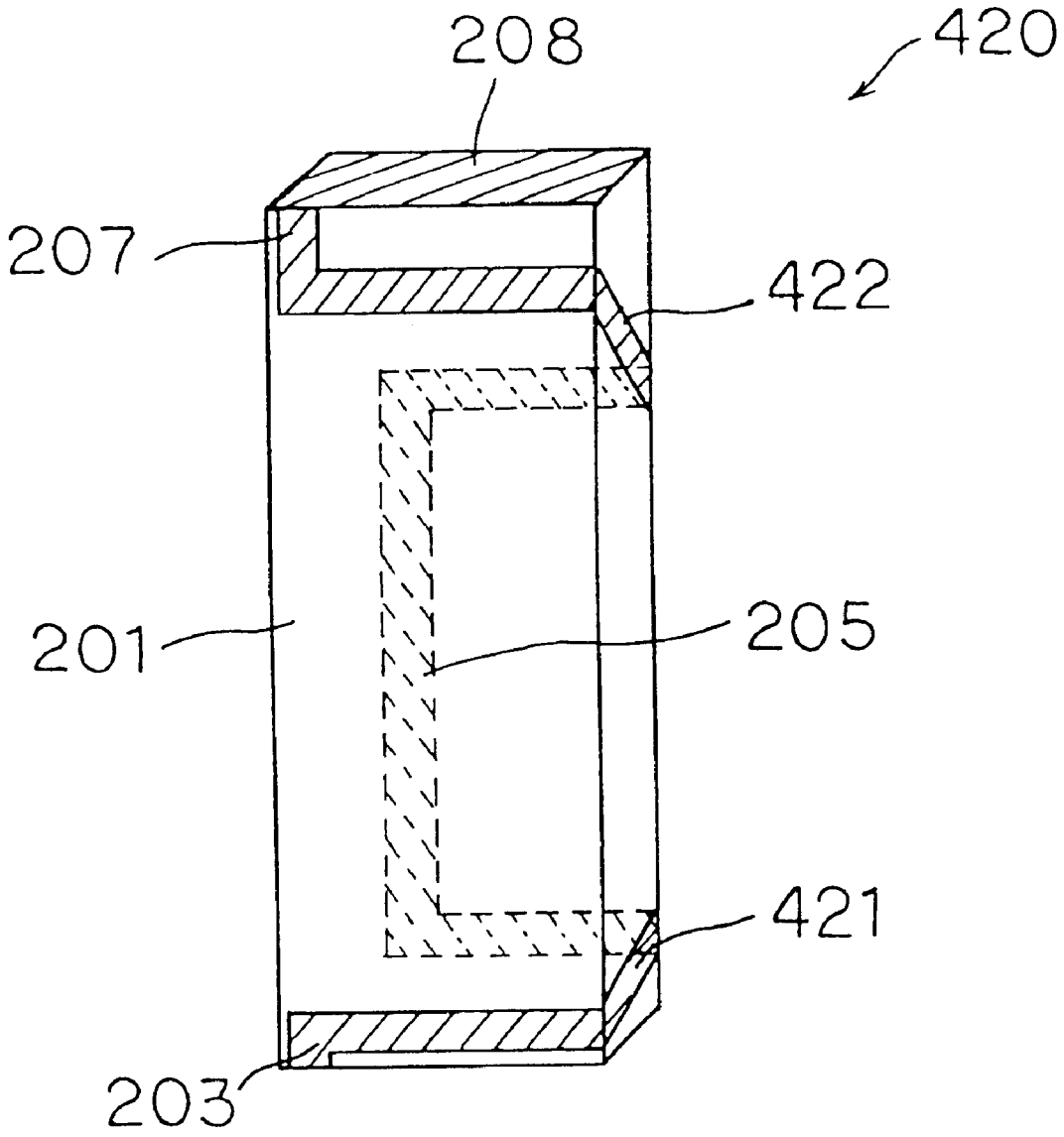
FIG. 10 is a perspective view illustrating a second exemplary modification.

It should be noted however that in the foregoing antenna element 410, portions of first/second conductors 411, 412 positioned on the front surface and the back surface of device substrate 201 are in close proximity to and in parallel with each other, giving rise to a concern of an increased distributed capacitance to reduce the bandwidth of radio communications. Thus, if the reduction in bandwidth is unacceptable, first and second conductors 421, 422 are preferably inclined in opposite directions on one side surface of device substrate 201 to form first and second conductors 421, 422 at different positions on the front surface and rear surface of device substrate 201, as antenna element 420 illustrated in FIG. 10.

In this structure, since the portions of first/second conductors 421, 422 positioned on the front surface and the back surface of device substrate 201 are spaced away from each other, the distributed capacitance can be reduced to extend the bandwidth of radio communication. Alternatively, even when first/second conductors 421, 422 are inclined in the same direction on the side surface of device substrate 201 (not shown), first/second conductors 421, 422 can be formed at different positions on the front surface and the back surface of device substrate 201 to reduce the distributed capacitance.

Figure 11:
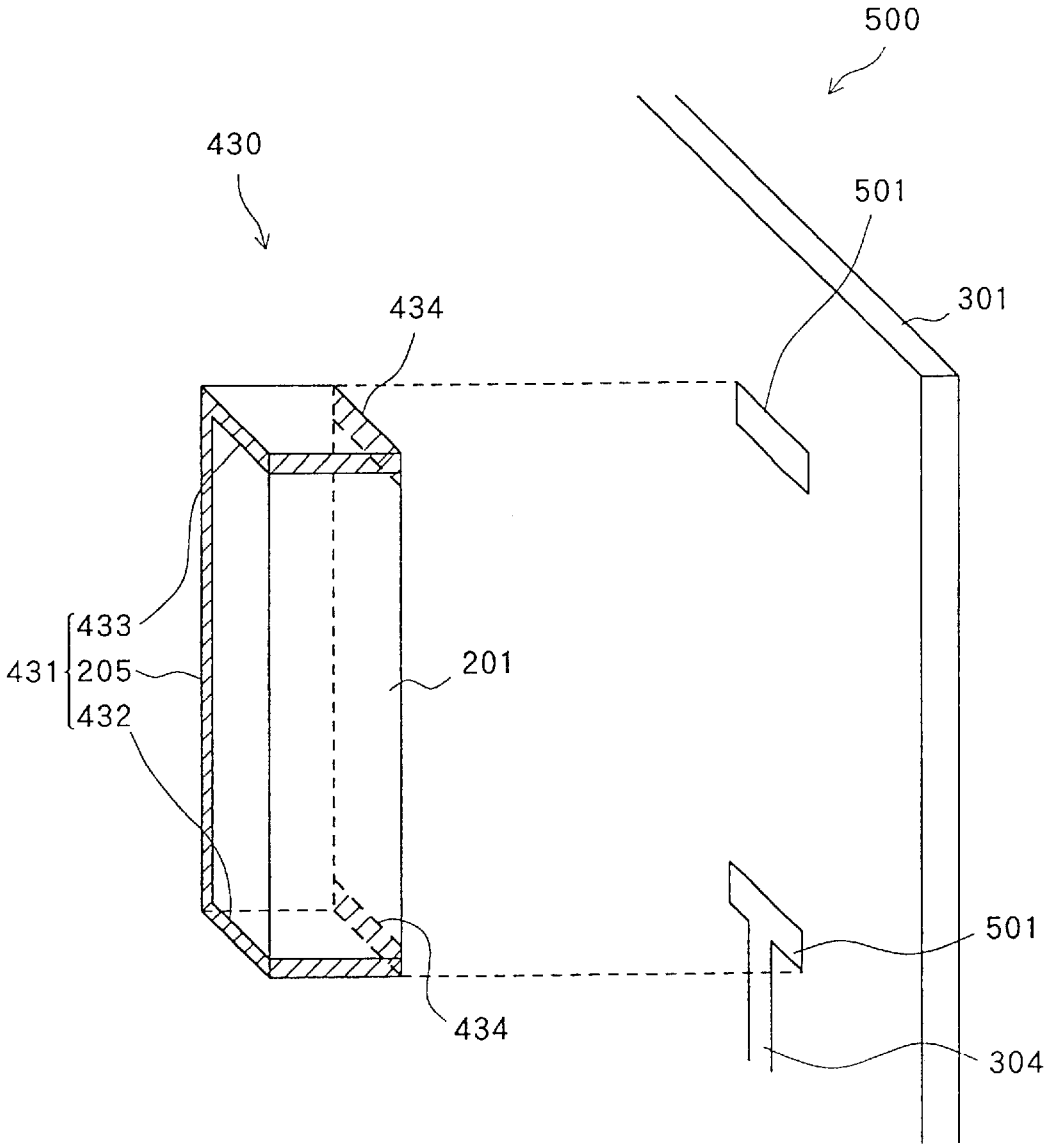
FIG. 11 is a perspective view illustrating a third exemplary modification.

Further, while antenna element 400 in the second embodiment illustrates that power supply conductor 203 is also formed integrally with conductive path 401 drawn on a plurality of outer surfaces of device substrate 201, no power supply conductor may be formed together with conductive path 431 drawn continuously on a plurality of outer surfaces of device substrate 201, as antenna element 430 illustrated in FIG. 11.

Antenna element 430 is formed with first/second conductors 432, 433 of conductive path 431 from the front surface to the back surface of device substrate 201, and connections 434 are formed at a leading end of first conductor 432 and at a terminate end of second conductor 433, positioned on the back surface of device substrate 201.

Then, in radio communication apparatus 500 utilizing antenna element 430, a pair of connections 501 are formed for connection with respective connections 434 on the front surface of circuit board 301 opposite to the back surface of device substrate 201, and power supply electrode 304 is connected to one of connections 501 connected to first conductor 432.

Because of the elimination of the need for forming a power supply conductor in conductive path 431, antenna element 430 as described above is simple in structure and highly productive. Moreover, since first/second conductors 432, 433 can be disposed at both ends of device substrate 201, the whole element can be further made compact.

Figure 12:
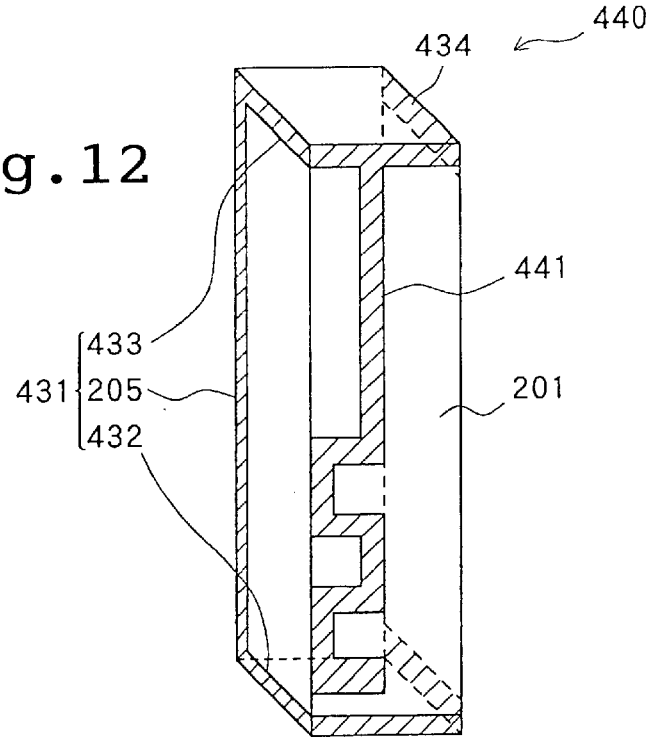
FIG. 12 is a perspective view illustrating a fourth exemplary modification.

Alternatively, as antenna element 440 illustrated in FIG. 12, resonant conductor 441 may be formed at a predetermined position of at least one of first/second conductors 432, 433 to the vicinity of the other one, such that a resonant circuit is formed of this resonant conductor 441 to support radio communications at a plurality of frequencies.

While in antenna element 440, a terminate end of resonant conductor 441 having a leading end connected to second conductor 433 is positioned near first conductor 432, a sufficient inductance can be generated because resonant conductor 441 is linear near the leading end and meandering near the terminate end. In addition, since resonant conductor 441 has a terminate end formed in parallel with first conductor 432, a sufficient capacitance can be generated as well, thereby providing a satisfactory resonant circuit formed of resonant conductor 441 and first conductor 432.

Also, while resonant conductor 441 has a leading end connected to second conductor 433 and a terminate end positioned near first conductor 432 in FIG. 12, resonant conductor 441 may have the leading end connected to first conductor 432 and the terminate end positioned near second conductor 433 (not shown), in which case the terminate ends of a pair of resonant conductors, which have the leading ends connected to first/second conductors 432, 433, respectively, can be placed in close proximity (not shown).

Further, while antenna element 440 in FIG. 12 illustrates resonant conductor 441 which is meandering near the terminate end and parallel with first conductor 432 near the leading end, the present invention can be implemented as well in an antenna element which has a resonant conductor (not shown) not formed in a meander shape, a resonant conductor (not shown) with a terminate end portion not in parallel with first conductor 432, and the like.

Figure 13:
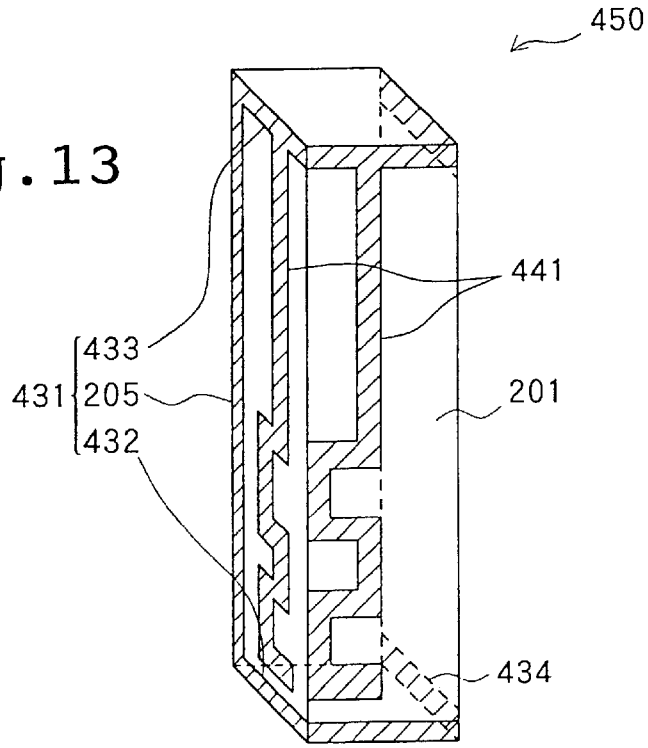
FIG. 13 is a perspective view illustrating a fifth exemplary modification.

Alternatively, as antenna element 450 illustrated in FIG. 13, a plurality of resonant conductors 411 can be connected one by one at a plurality of positions on second conductor 433. In such antenna element 450, since a plurality of resonant circuits formed of the plurality of resonant conductors 441 differ in resonant frequency from one another, antenna element 450 can support radio communications at a plurality of frequencies. Further, when the plurality of frequencies are close to one another, communication frequencies can be virtually provided in a wide band.

While preferred embodiments) of the present invention has (have) been described using specific terms, such description is for illustrative purposes only, and it is to be understood that changes and variations may be made without departing from the spirit or scope of the following claims.

What is claimed is:

1. An antenna element comprising:

a first conductor made of a linear conductor and supplied with electric power at a leading end thereof;

a short-circuit conductor connected perpendicularly to a terminate end of said first conductor;

a second conductor connected perpendicularly to a terminate end of said short-circuit conductor and positioned in parallel with said first conductor; and a device substrate made of at least one of a dielectric material and a magnetic material, and having a conductive path formed on its outer surface, said conductive path comprising said first conductor, said short-circuit conductor and said second conductor;

wherein at least one of said first conductor and said second conductor has an extended portion bent in a U-shape having three straight lines forming two right angles, wherein a leg of said extended portion is connected to one of said first and second conductors, and wherein said first and second conductors and said short-circuit conductor bound an area, said extended portion being within said area.

2. The antenna element according to claim 1, further comprising a power supply conductor having a terminate end connected at a right angle to a leading end of said first conductor on the side opposite to said short-circuit conductor, said power supply conductor being supplied with electric power at a leading end thereof, said power supply conductor being formed as part of said conductive path.

3. The antenna element according to claim 2, wherein:

said extended portion is connected to the leading end of said first conductor, and a leading end of said extended portion is linearly connected to a terminate end of said power supply conductor.

4. The antenna element according to claim 1, wherein:

said extended portion is connected to the terminate end of said first conductor, and a terminate end of said extended portion is linearly connected to a leading end of said short-circuit conductor.

5. The antenna element according to claim 1, wherein:

said extended portion is connected to the leading end of said-second conductor, and a leading end of said extended portion is linearly connected to a terminate end of said short-circuit conductor.

6. The antenna element according to claim 1, further comprising:

a capacitive conductor having a given capacitance connected to a terminate end of said second conductor through a connection conductor, wherein said extended portion is connected to the terminate end of said second conductor, and a terminate end of said extended portion is linearly connected to a leading end of said connection conductor.

7. The antenna element according to claim 1, further comprising:

a capacitive conductor having a given capacitance connected to a terminate end of said second conductor.

8. The antenna element according to claim 1, further comprising:

a capacitive conductor having a given capacitance, said second conductor being formed integrally with said capacitive conductor.

9. The antenna element according to claim 1, further comprising:

a resonant conductor formed at a predetermined position of at least one of said first conductor and said second conductor to the vicinity of the other one of said first conductor and said second conductor to form a resonant circuit, said resonant conductor being formed integrally with said conductive path.

10. The antenna element according to claim 9, comprising a plurality of said resonant conductors connected respectively to at least one of said first conductor and said second conductor.

11. A radio communication apparatus comprising:

the antenna element according to claim 1;

power supply means for supplying electric power to the conductive path of said antenna element; and signal transmitting means for feeding a transmission signal to the conductive path of said antenna element.

12. A radio communication apparatus comprising:

the antenna element according to claim 1;

power supply means for supplying electric power to the conductive path of said antenna element; and signal receiving means for receiving a signal from the conductive path of said antenna element.

13. A radio communication apparatus comprising:

the antenna element according to claim 1;

power supply means for supplying electric power to the conductive path of said antenna element;

signal transmitting means for feeding a transmission signal to the conductive path of said antenna element; and signal receiving means for receiving a signal from the conductive path of said antenna element.

14. An antenna element comprising:

a first conductor made of a linear conductor and supplied with electric power at a leading end thereof;

a short-circuit conductor connected perpendicularly to a terminate end of said first conductor;

a second conductor connected perpendicularly to a terminate end of said short-circuit conductor and positioned in parallel with said first conductor; and a device substrate made of at least one of a dielectric material and a magnetic material in a polygonal shape, and having a conductive path formed on its outer surface, said conductive path comprising said first conductor, said short-circuit conductor and said second conductor, wherein said first conductor is arranged continuously on a plurality of outer surfaces of said device substrate; and said second conductor is formed continuously on a plurality of outer surfaces of said device substrate.

15. The antenna element according to claim 14, further comprising a power supply conductor having a terminate end connected at a right angle to a leading end of said first conductor on the side opposite to said short-circuit conductor, said power supply conductor being supplied with electric power at a leading end thereof, said power supply conductor being formed as part of said conductive path.

16. The antenna element according to claim 15, wherein:

said extended portion is connected to the leading end of said first conductor, and a leading end of said extended portion is linearly connected to a terminate end of said power supply conductor.

17. The antenna element according to claim 14, wherein:

said device substrate is formed in a rectangular solid, and said first conductor and said second conductor are each formed from the front surface to the back surface across one side surface of said device substrate.

18. The antenna element according to claim 17, wherein said first conductor is arranged at a position on the front surface different from a position on the back surface of said device substrate.

19. The antenna element according to claim 17, wherein said second conductor is arranged at a position on the front surface different from a position on the back surface of said device substrate.

20. The antenna element according to claim further comprising:

a capacitive conductor having a given capacitance connected to a terminate end of said second conductor.

21. The antenna element according to claim 14, further comprising:

a capacitive conductor having a given capacitance, said second conductor being formed integrally with said capacitive conductor.

22. The antenna element according to claim 14, further comprising:

a resonant conductor formed at a predetermined position of at least one of said first conductor and said second conductor to the vicinity of the other one of said first conductor and said second conductor to form a resonant circuit, said resonant conductor being formed integrally with said conductive path.

23. The antenna element according to claim 22, comprising a plurality of said resonant conductors connected respectively to at least one of said first conductor and said second conductor.

24. A radio communication apparatus comprising:

the antenna element according to claim 14;

power supply means for supplying electric power to the conductive path of said antenna element; and signal transmitting means for feeding a transmission signal to the conductive path of said antenna element.

25. A radio communication apparatus comprising:

the antenna element according to claim 14;

power supply means for supplying electric power to the conductive path of said antenna element; and signal receiving means for receiving a signal from the conductive path of said antenna element.

26. A radio communication apparatus comprising:

the antenna element according to claim 14;

power supply means for supplying electric power to the conductive path of said antenna element;

signal transmitting means for feeding a transmission signal to the conductive path of said antenna element; and signal receiving means for receiving a signal from the conductive path of said antenna element.

27. An antenna element comprising:

a first conductor made of a linear conductor and supplied with electric power at a leading end thereof;

a short-circuit conductor connected perpendicularly to a terminate end of said first conductor;

a second conductor connected perpendicularly to a terminate end of said short-circuit conductor and positioned in parallel with said first conductor; and a device substrate made of at least one of a dielectric material and a magnetic material in a polygonal shape, and having a conductive path formed on its outer surface, said conductive path comprising said first conductor, said short-circuit conductor and said second conductor;

wherein said first conductor is arranged continuously on a plurality of outer surfaces of said device substrate;

said second conductor is formed continuously on a plurality of outer surfaces of said device substrate; and at least one of said first conductor and said second conductor has an extended portion bent in a U-shape having three straight lines forming two right angles.

28. The antenna element according to claim 27, further comprising a power supply conductor having a terminate end connected at a right angle to a leading end of said first conductor on the side opposite to said short-circuit conductor, said power supply conductor being supplied with electric power at a leading end thereof, said power supply conductor being formed as part of said conductive path.

29. The antenna element according to claim 28, wherein:

said extended portion is connected to the leading end of said first conductor, and a leading end of said extended portion is linearly connected to a terminate end of said power supply conductor.

30. The antenna element according to claim 27, wherein:

said device substrate is formed in a rectangular solid, and said first conductor and said second conductor are each formed from the front surface to the back surface across one side surface of said device substrate.

31. The antenna element according to claim 30, wherein said first conductor is arranged at a position on the front surface different from a position on the back surface of said device substrate.

32. The antenna element according to claim 30, the wherein said second conductor is arranged at a position on the front surface different from a position on the back surface of said device substrate.

33. The antenna element according to claim 27, wherein:

said extended portion is connected to the terminate end of said first conductor, and a terminate end of said extended portion is linearly connected to a leading end of said short-circuit conductor.

34. The antenna element according to claim 27, wherein:

said extended portion is connected to the leading end of said second conductor, and a leading end of said extended portion is linearly connected to a terminate end of said short-circuit conductor.

35. The antenna element according to claim further comprising:

a capacitive conductor having a given capacitance connected to a terminate end of said second conductor through a connection conductor, wherein said extended portion is connected to the terminate end of said second conductor, and a terminate end of said extended portion is linearly connected to a leading end of said connection conductor.

36. The antenna element according to claim 27, further comprising:

a capacitive conductor having a given capacitance connected to a terminate end of said second conductor.

37. The antenna element according to claim 27, further comprising:

a capacitive conductor having a given capacitance, said second conductor being formed integrally with said capacitive conductor.

38. The antenna element according to claim further comprising:

a resonant conductor formed at a predetermined position of at least one of said first conductor and said second conductor to the vicinity of the other one of said first conductor and said second conductor to form a resonant circuit, said resonant conductor being formed integrally with said conductive path.

39. The antenna element according to claim 38, comprising a plurality of said resonant conductors connected respectively to at least one of said first conductor and said second conductor.

40. A radio communication apparatus comprising:

the antenna element according to claim 27;

power supply means for supplying electric power to the conductive path of said antenna element; and signal transmitting means for feeding a transmission signal to the conductive path of said antenna element.

41. A radio communication apparatus comprising:

the antenna element according to claim 27;

power supply means for supplying electric power to the conductive path of said antenna element; and signal receiving means for receiving a signal from the conductive path of said antenna element.

42. A radio communication apparatus comprising:

the antenna element according to claim 27;

power supply means for supplying electric power to the conductive path of said antenna element;

signal transmitting means for feeding a transmission signal to the conductive path of said antenna element; and signal receiving means for receiving a signal from the conductive path of said antenna element.

* * * * *